US005390388A

United States Patent [19]

Cutler

[11] Patent Number: 5,390,388

[45] Date of Patent: Feb. 21, 1995

[54] APPARATUS FOR DRY CLEANING CARPETS WITH REMOVABLE SOLUTION CONTAINER

[76] Inventor: Barry L. Cutler, 7 Stanford Ct., East Windsor, N.J. 08520

[21] Appl. No.: 238,483

[22] Filed: May 5, 1994

[51] Int. Cl.[6] ..... A47L 11/34

[52] U.S. Cl. ..... 15/98; 15/50.1; 248/146; 248/311.2

[58] Field of Search ..... 15/50.1–50.3, 15/51, 52, 98; 248/146, 150, 154, 310, 311.2, 313

[56] References Cited

U.S. PATENT DOCUMENTS

| | | | |
|---|---|---|---|
| 3,036,321 | 5/1962 | Holt | 15/50.1 |
| 3,046,586 | 7/1962 | Allen et al. | 15/50.1 |
| 4,295,622 | 10/1981 | Cutler | 248/313 |
| 4,418,438 | 12/1983 | Cutler | 15/230 |
| 4,524,477 | 6/1985 | Williams, III et al. | 15/50.1 |

FOREIGN PATENT DOCUMENTS

| | | | |
|---|---|---|---|
| 834149 | 5/1960 | United Kingdom | 15/50.1 |

*Primary Examiner*—Mark Spisich

*Attorney, Agent, or Firm*—Donald S. Cohen

[57] ABSTRACT

An apparatus for dry cleaning carpets and the like includes a base having a pad holder at its bottom and a motor on its top. The motor is connected to the pad holder to rotate the pad holder. A handle extends from the base and wheels are mounted on the base. A liquid cleaning solution container is mounted on the motor. A bottom plate having an annular flange extending downwardly from its periphery is mounted on and secured to the top of the motor by bolts extending through the bottom plate and threaded into the motor. A top plate having an annular flange extending upwardly from its periphery is mounted on and secured to the bottom of the container by bolts extending from the container through holes in the top plate and nuts threaded on the bolts. The top plate is seated on the bottom plate, and a rigid but slightly resilient pad is provided between the top and bottom plates. Quick release clamps are mounted on the flange of the top plate and releasably engage the flange of the bottom plate to secure the container firmly on the motor, but allow for ease of removing and replacing the container.

13 Claims, 2 Drawing Sheets

APPARATUS FOR DRY CLEANING CARPETS WITH REMOVABLE SOLUTION CONTAINER

FIELD OF THE INVENTION

The present invention relates to an apparatus for dry cleaning carpets, and, more particularly to such an apparatus having a solution container which can be easily and quickly removed and replaced.

BACKGROUND OF THE INVENTION

Two techniques typically used to clean floor carpets, rugs and the like are wet cleaning, such as hot water extraction or so-called "steam cleaning" and shampooing, and dry cleaning. For dry cleaning carpets, a cleaning fluid is sprayed onto the carpet and a pad is rotated over the carpet to work the cleaning solution into the carpet and thereby remove the dirt, and to absorb the dirty cleaning solution from the carpet. The dry cleaning technique has the advantage over the wet technique in that it does not soak the carpet and any underlying padding, and thereby does not damage the carpet and padding.

One type of apparatus which has been used for dry cleaning carpets is shown and described in U.S. Pat. No. 4,295,622, to B. L. Cutler, issued Oct. 20, 1981 and entitled "Framework Holder For Attaching Container To Floor Machine". This apparatus includes a base having a flat, circular pad holder across its bottom. A motor is mounted on top of the base and drives a shaft for rotating the pad holder. A handle extends from the base to permit the apparatus to be moved across a carpet. A container is mounted on the motor and contains a dry cleaning liquid solution. A pump is mounted in the container to pump the dry cleaning solution from the container to a spray nozzle on the container which sprays the carpet ahead of the apparatus. A dry cleaning pad is mounted on the bottom of the pad holder. The pad has portions which scrub the dry cleaning solution into the carpet to remove the dirt, and portions which soak up the dirty dry cleaning solution. One such pad is shown in U.S. Pat. No. 4,418,438, to B. L. Cutler, issued Dec. 6, 1983, entitled "Rotary Carpet Cleaning Pad".

It is desirable that the cleaning solution container be mounted on the motor so that the container can be easily and quickly removed and be replaced on the motor. This is to allow for draining and cleaning of the container, and also to allow for changing to different types and sizes of the container. Although the mounting means for the cleaning solution container shown in U.S. Pat. No. 4,295,622, does allow the container to be removed and replaced, it requires the releasing and tightening of straps which can be somewhat time consuming. Also, if the straps holding the container to the motor are not tight enough, the container can move about and is not firmly secured in place to the motor. Therefore, it is desirable to having a mounting means for the solution container which allows for quick and easy removal and replacement of the container on the motor, and which firmly holds the container in place on the motor.

SUMMARY OF THE INVENTION

An apparatus for dry cleaning carpets and the like includes a base, a motor mounted on the base and having a top surface, and a cleaning solution container on the motor and having a bottom surface. A bottom plate is on and secured to the top surface of the motor, and a top plate is on and secured to the bottom surface of the container. A plurality of quick release clamps are secured to the top plate and releasably engage the bottom plate to secure the container to the motor.

DETAILED DESCRIPTION

Figure 1:
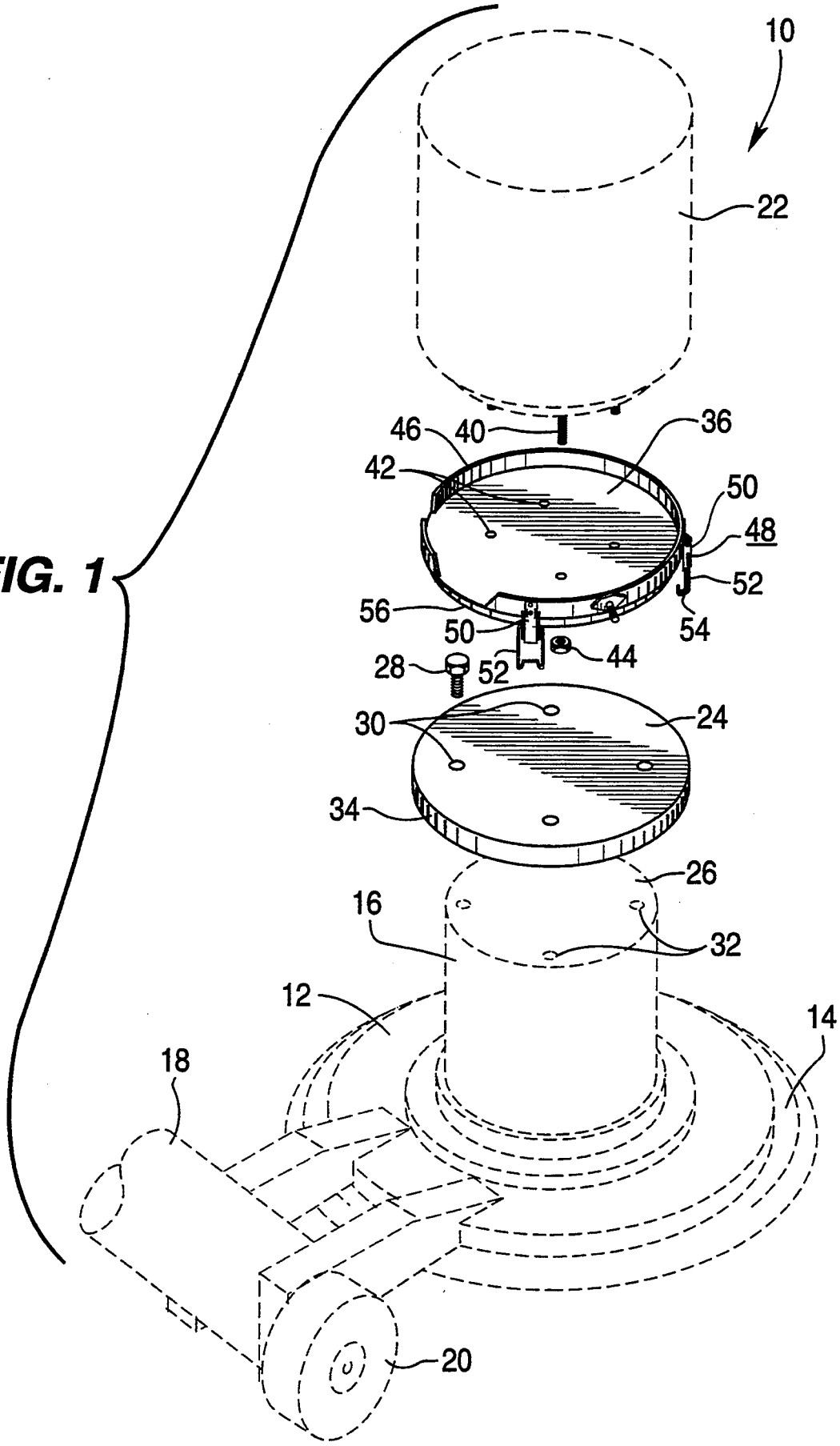
FIG. 1 is an exploded perspective view of the carpet cleaning apparatus of the present invention.
Figure 2:
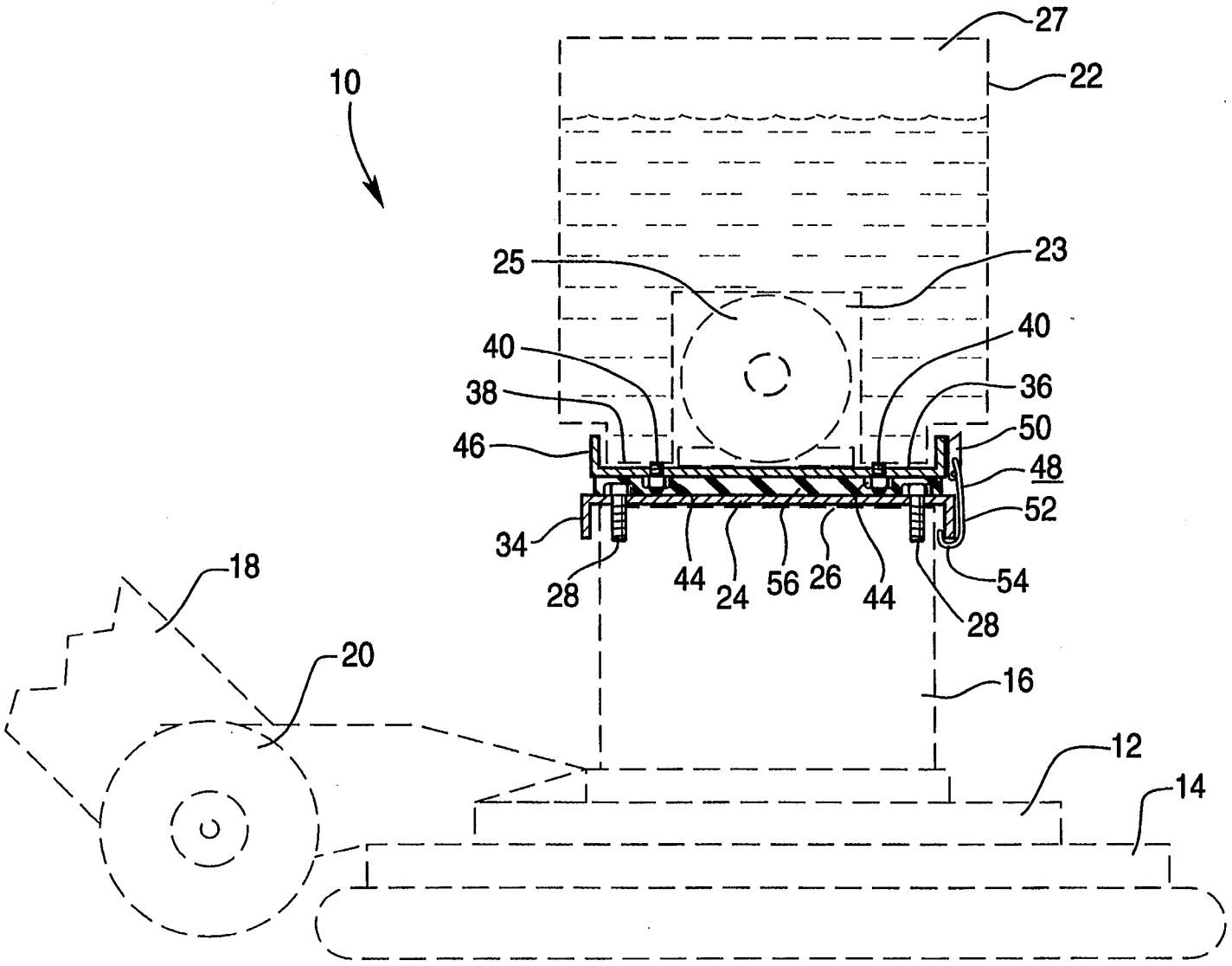
FIG. 2 is a sectional view of the mounting structure for the solution container with the rest of the apparatus being shown in phantom.

Referring to the drawings, the dry cleaning apparatus of the present invention is generally designated as 10. Apparatus 10 comprises a base 12 having a flat, circular pad holder 14 extending across the bottom thereof. A motor 16 is mounted on the top of the base 12. The motor 16 has a shaft (not shown) which is connected to the pad holder 14 so as to rotate the pad holder 14. A handle 18 is connected to the base 12 to permit moving the base 12 and the pad holder 14 over a carpet to be cleaned. A pair of wheels 20 (only one of which is shown) are mounted on the base 12 to allow the base 12 to be moved around when it is not being used for cleaning. A container 22 is mounted on the base 12. As shown in FIG. 2, the container 22 has therein a chamber 23 which contains a motor-pump assembly 25, and a second chamber 27 for containing a cleaning solution.

A circular metal bottom plate 24 is on the top surface 26 of the motor 16. The bottom plate 24 is secured to the motor 16 by bolts 28 which extend through holes 30 in the bottom plate 24 and are threaded into holes 32 in the top surface 26 of the motor 16. The bottom plate 24 is of a diameter slightly larger than the diameter of the top surface 26 of the motor 16. Thus, the bottom plate 24 projects radially outwardly beyond the motor 16. An annular flange 34 extends downwardly from the periphery of the bottom plate 24. Since the bottom plate 24 is larger than the top surface 26 of the motor 16, the flange 34 is spaced from the outer surface of the motor 16.

A circular metal top plate 36 is on the bottom 38 of the container 22. Bolts 40 projecting from the bottom 38 of the container 22 extend through holes 42 in the top plate 36. Nuts 44 are threaded on the bolts 40 to secure the top plate 36 to the container 22. The top plate 36 has an annular flange 46 projecting upwardly from its periphery and around a portion of the container 22. A plurality of quick release clamps 48, only two of which are shown, are mounted in spaced relation around the annular flange 46. Each of the clamps 48 comprises a lever arm 50 pivotally mounted at its top end to the flange 46. A hook arm 52 has its top end pivotally mounted on the lever arm 50 intermediate the ends of the lever arm 50. The hook arm 52 has a U-shaped hook 54 at its lower free end. A circular pad 56 of a firm but slightly resilient material, such as a hard rubber, is mounted on and secured to the bottom surface of the top plate 36.

To secure the container 22 to the motor 16, the container 22 is mounted on the motor 16 with the pad 56 being seated on the bottom plate 24. The lever arm 50 of each clamp 48 is pivoted so that its free end is down and the hook arm 52 is hanging below the lever arm 50. The hook 54 of each hook arm 52 is placed under the lower edge of the flange 34 of the bottom plate 24 as shown in FIG. 2. The lever arm 50 is then pivoted upwardly to the position shown in FIG. 2. This pulls the hook 54 of the hook arm 52 tightly against the lower edge of the flange 34 and, thereby, pulls the top plate 36 and the pad 56 tightly against the bottom plate 24. Thus, the top plate 36 is firmly secured to the bottom plate 24 so as to firmly and tightly secure the container 22 to the motor 16.

To remove the container 22 from the motor 16, it is only necessary to pivot the lever arm 50 of each clamp 48 so that its free end is down. This lowers the hook arm 52 so that the hook 54 is moved downwardly away from the lower edge of the flange 34 of the bottom plate 24. With the hook arms 52 of the clamps 48 being free of the flange 34 of the bottom plate 24, the container 22 is now free to be lifted and removed from the motor 16. Thus, the container 22 can be easily and quickly removed from and replaced onto the motor 16. When secured to the motor 16, the container 22 is secured firmly and tightly in place on the motor 16 so that it does not vibrate or move during the operation of the cleaning apparatus 10.

Thus, there is provided by the present invention a dry cleaning apparatus for carpet, rugs and the like having a cleaning solution container mounted on a motor so that the container can be easily and quickly removed and replaced. However, the chamber is secured to the motor in a manner in which the container is firmly and tightly mounted on the motor so that the container will not move or vibrate during the operation of the cleaning apparatus.

What is claimed is:

1. An apparatus for dry cleaning a surface comprising:

a base:

a motor mounted on the base and having a top surface;

means mounted on the motor for supporting means for dry cleaning the surface;

a cleaning solution container having a bottom surface and mounted on the motor;

a circular bottom plate on and secured to the top surface of the motor, said bottom plate being larger in diameter than the top surface of the motor so as to project radially outwardly from the motor and having an annular flange extending downwardly from its periphery;

a top plate on and secured to the bottom surface of the container and having an annular flange extending upwardly from its outer periphery; and a plurality of quick release clamps secured in spaced relation to the flange of the top plate and extending along and under the flange of the bottom plate to releasably engage the bottom plate to secure the container to the motor.

2. The apparatus of claim 1 in which each of the clamps comprises a lever arm pivotally mounted at its top end to the flange of the top plate, and a hook arm pivotally mounted at one end to the lever arm between the ends of the lever arm, the hook arm having a hook at its other end which fits under the flange of the bottom plate to secure the container to the motor.

3. The apparatus of claim 2 further comprising a rigid but slightly resilient pad between the bottom plate and the top plate.

4. The apparatus of claim 3 in which the pad is of a relatively rigid rubber.

5. The apparatus of claim 1 in which the top plate is secured to the bottom of the container by bolts extending from the bottom of the container through holes in the top plate and nuts threaded on the bolts.

6. The apparatus of claim 5 in which the bottom plate is secured to the top surface of the motor by bolts extending through holes in the bottom plate and threaded into holes in the motor.

7. The apparatus of claim 1 including a handle extending from the base, and a pair of wheels on the base to allow for ease of moving the apparatus.

8. An apparatus for dry cleaning a surface comprising:

a base;

a motor mounted on the base and having a top surface;

means mounted on the motor for supporting means for dry cleaning the surface;

a handle extending from the base;

wheels mounted on the base;

a cleaning solution container having a bottom surface and mounted on said motor;

a bottom plate mounted on the top surface of the motor and having an annular flange extending downwardly from its periphery;

a top plate mounted on the bottom surface of the container and having an annular flange extending upwardly from its periphery; and a plurality of quick release clamps mounted in spaced relation around the annular flange on the top plate, said clamps releasably engaging the bottom edge of the flange on the bottom plate to secure the container firmly to the motor.

9. The apparatus of claim 8 in which each of the clamps comprises a lever arm pivotally mounted at its top end to the flange of the top plate, and a hook arm pivotally mounted at one end to the lever arm between the ends of the lever arm, the hook arm having a U-shaped hook at its end which extends under the flange on the bottom plate to secure the container to the motor.

10. The apparatus of claim 9 including a rigid but slightly resilient pad between the bottom plate and the top plate.

11. The apparatus of claim 10 in which the pad is of a relatively rigid rubber.

12. The apparatus of claim 10 in which the top plate is secured to the bottom of the container by bolts extending from the bottom of the container through holes in the top plate, and nuts threaded on the bolts.

13. The apparatus of claim 12 in which the bottom plate is secured to the motor by bolts extending through holes in the bottom plate and threaded into holes in the motor.

* * * * *